US006510583B2

(12) United States Patent
Griffin et al.

(10) Patent No.: US 6,510,583 B2
(45) Date of Patent: Jan. 28, 2003

(54) CORD RETAINER FOR VACUUM CLEANER

(75) Inventors: Ronald Griffin, Williamsport, PA (US); Kevin Fry, So Williamsport, PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/822,570

(22) Filed: Mar. 30, 2001

(65) Prior Publication Data

US 2002/0138937 A1 Oct. 3, 2002

(51) Int. Cl.[7] ..... A47L 9/26
(52) U.S. Cl. ..... 15/323; 15/353; 242/400.1
(58) Field of Search ..... 15/323, 353; 242/400.1, 242/405.1, 405.2

(56) References Cited

U.S. PATENT DOCUMENTS

| | | | | | |
|---|---|---|---|---|---|
| 1,746,246 | A | * | 2/1930 | Elworthy | 242/400.1 |
| 2,003,147 | A | * | 5/1935 | Holm-Hansen | 242/400.1 |
| 2,037,668 | A | * | 4/1936 | Smith et al. | 242/400.1 |
| 3,667,084 | A | * | 6/1972 | Valbona et al. | 15/323 |
| 4,204,297 | A | | 5/1980 | Yasunaga et al. | 15/323 |
| 4,512,057 | A | * | 4/1985 | Laing et al. | 15/350 |
| 4,658,465 | A | | 4/1987 | Keane et al. | 15/323 |
| 4,720,890 | A | | 1/1988 | Jacob | 15/323 |
| 4,809,393 | A | * | 3/1989 | Goodrich et al. | 15/323 |
| 4,912,593 | A | | 3/1990 | Iwao et al. | 361/212 |
| 5,014,385 | A | * | 5/1991 | Bradd et al. | 15/323 |
| 5,107,567 | A | | 4/1992 | Ferrari et al. | 15/350 |
| 5,318,158 | A | | 6/1994 | Seasholtz | 191/12 R |
| 5,513,816 | A | * | 5/1996 | Grubb | 242/400.1 |
| 5,573,422 | A | | 11/1996 | Lawliss | 439/448 |
| 5,659,918 | A | | 8/1997 | Anthony et al. | 15/320 |
| 5,836,045 | A | | 11/1998 | Anthony et al. | 15/320 |
| 5,957,721 | A | | 9/1999 | Searle et al. | 439/501 |
| 6,012,200 | A | | 1/2000 | Murphy et al. | 15/347 |
| 6,012,940 | A | | 1/2000 | Wheeler | 439/369 |
| 6,131,237 | A | | 10/2000 | Kasper et al. | 15/320 |

* cited by examiner

*Primary Examiner*—Theresa T. Snider
(74) *Attorney, Agent, or Firm*—Marshall, Gerstein & Borun

(57) ABSTRACT

A vacuum cleaner has a cord retainer for holding looped cord in a horizontal position against the housing of the vacuum cleaner. The cord retainer includes two cord locks that are pivotally mounted to the vacuum cleaner housing. The cord locks are limited in their pivotal movement from a horizontal or near horizontal position to a vertical or near vertical position. The cord locks are mounted onto shafts which, in turn, are either integrally molded with the vacuum cleaner housing or connected to the vacuum cleaner housing in a suitable fashion.

20 Claims, 6 Drawing Sheets

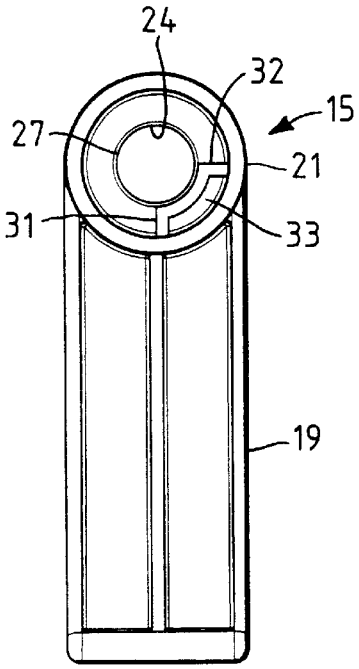
FIG. 6
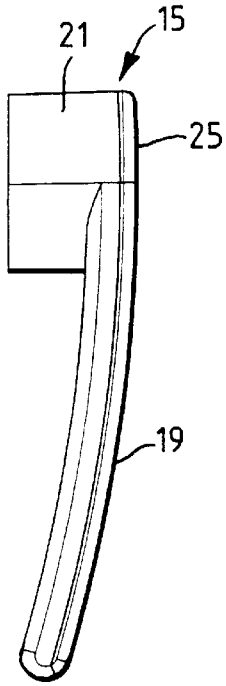
FIG. 7
FIG. 5
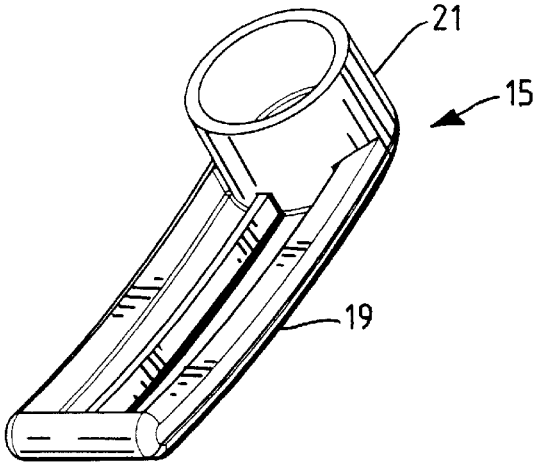

CORD RETAINER FOR VACUUM CLEANER

FIELD OF THE INVENTION

The present invention relates generally to vacuum cleaners and more particularly to a vacuum cleaner with a cord retainer for releasably holding the looped power cord in a horizontal position along the housing of the vacuum cleaner.

BACKGROUND ART

In canister-type vacuum cleaners, automatic power cord retention devices are often employed to store the power cord within the body of the canister or in a body-mounted spring-actuated retractable cord reel device. On the other hand, upright vacuum cleaners typically include spaced hooks disposed on the handle about which the cord is wrapped when the vacuum cleaner is stored.

These two cord retaining means are not generally applicable to tank-type vacuum cleaners. Specifically, due to the necessity of a larger tank for collecting the debris and/or fluid, there is no convenient spot to mount a cord reel device inside of the housing or on the housing of a tank-type vacuum cleaner. There is no typically convenient place to mount retaining hooks around which the cord can be wrapped. U.S. Pat. No. 4,912,593 discloses a tank-type vacuum cleaner with two cord retaining hooks mounted on the housing in vertical alignment with each other. The lower hook can pivot approximately 180° to facilitate removal of the looped cord. However, this design is problematic because the user must bend down to the floor level to reach the lower hook before twisting it and releasing the cord. Further, when the tank is empty, tank-type vacuum cleaners tend to be top-heavy and therefore wrapping the cord in a vertical loop can result in the vacuum cleaner being tipped over.

Accordingly, there is a need for an improved cord retaining system for tank-type vacuum cleaners that is easier to use.

SUMMARY OF THE INVENTION

In accordance with one refinement of the present invention, a cord retainer for a vacuum cleaner includes two shafts, a right shaft and a left shaft, that extend horizontally outward from the housing of the tank-type vacuum cleaner. The right and left shafts each include two stops—a first stop and a second stop. Each shaft is also pivotally connected to a cord lock, e.g., the right shaft is pivotally connected to a right cord lock and the left shaft is pivotally connected to a left cord lock. The right and left cord locks each includes a base for receiving its respective shaft and a leg portion that extends substantially perpendicularly outward from the base. The leg portions serve as hooks for retaining the cord. The right cord lock includes a first stop for engaging the first stop of the right shaft and a second stop for engaging the second stop of the right shaft. The right cord lock is pivotable along an arc limited by engagement of the first stops of the right shaft and right cord lock and by engagement of the second stops of the right shaft and right cord lock. Similarly, the left cord lock includes a first stop for engaging the first stop of the left shaft and a second stop for engaging the second stop of the left shaft. The left cord lock is also pivotable along an arc limited by engagement of the first stops of the left shaft and left cord lock and by engagement of the second stops of the left shaft and left cord lock.

In accordance with another refinement of the present invention, the right and left shafts are disposed along a horizontal plane thereby permitting the cord to be looped around the cord locks in a horizontal fashion.

In accordance with another refinement of the present invention, the arc through which the right cord lock can pivot ranges from about 80° to about 135° and the arc through which the left cord lock can pivot ranges from about 80° to about 135°.

In accordance with a further refinement of the present invention, the right and left cord locks can pivot through an arc of about 90°.

In another refinement of the present invention, the first stop of the right shaft engages the first stop of the right cord lock when the right cord lock is in a first position. The second stop of the right shaft engages the second stop of the right cord lock when the right cord lock is in a second position. The first stop of the left shaft engages the first stop of the left cord lock when the left cord lock is in a first position. And, the second stop of the left shaft engages the second stop of the left cord lock when the left cord lock is in a second position. The legs of the right and left cord locks are substantially coplanar and oppositely directed when the right and left cord locks are in their respective first positions and the legs of the right and left cord locks are substantially parallel and directed upwardly when the right and left locks are in their respective second positions.

In a further refinement of the present invention, the first and second stops of the right cord lock are disposed within the base and along an arc of about 90° apart from each other and the first and second stops of the right shaft are disposed along an arc of about 180° from each other. Similarly, the first and second stops of the left cord lock are disposed along an arc of about 90° from each other and the first and second stops of the left shaft are disposed along an arc of about 180° from each other.

In still a further refinement of the present invention, the first and second stop of the right cord lock are connected by an arcuate wall and the first and second stops of the left cord lock are connected by an arcuate wall.

In yet another refinement of the present invention, the right shaft comprises an outwardly directed male protuberance and the right cord lock comprises a top wall having a female opening. The male protuberance of the right shaft is snap fitted into the female opening of the right cord lock. Similarly, the left shaft comprises an outwardly directed male protuberance and the left cord lock comprises a top wall having a female opening. The male protuberance of the left shaft is snap fitted into the female opening of the left cord lock.

In yet another refinement of the present invention, the right cord lock is interchangeable with the left cord lock and, hence, a single part can serve as both a right cord lock or a left cord lock.

In yet another refinement of the present invention, the right and left shafts are fast with or integrally connected to the housing. In such a refinement, the right and left shafts may be molded as a part of the housing.

In another refinement of the present invention, a vacuum cleaner is provided which includes a housing. The housing is connected to a right shaft and a left shaft. The right and left shafts extend outward from the housing and both the right and left shafts each comprise a first stop and a second stop. The right shaft is pivotally connected to a right cord lock and the left shaft is pivotally connected to a left cord lock. The right and left cord locks each comprise a hollow base for receiving one of the right and left shafts respectively and a leg portion that extends substantially perpendicularly outward from its respective base. The hollow base of the right cord lock comprises a first stop for engaging the first stop of the right shaft and a second stop for engaging the second stop of the right shaft. Similarly, the hollow base of the left cord lock comprises a first stop for engaging the first stop of the left shaft and a second stop for engaging the second stop of the left shaft. The first stop of the right shaft engages the first stop of the right cord lock when the right cord lock is in a first position and the second stop of the right shaft engages the second stop of the right cord lock when the right cord lock is in a second position. Similarly, the first stop of the left shaft engages the first stop of the left cord lock when the left cord lock is in a first position and the second stop of the left shaft engages the second stop of the left cord lock when the left cord lock is in a second position. The legs of the right and left cord locks are substantially coplanar and are directed in substantially opposite directions when the right and left cord locks are in their respective first positions. In these first positions, the cord may be wrapped around the cord locks and secured in place against the housing of the vacuum cleaner. When the right and left cord locks are in their respective second positions, the legs of the right and left cord locks are disposed substantially parallel and directed upward thereby permitting easy removal of the looped cord from the cord locks. It will be noted that only one of the cord locks needs to be turned upward to the second position in order to remove the looped cord from the locks.

In a further refinement of the present invention, the right and left shafts are connected to the housing along a horizontal plane when the vacuum cleaner is in an upright position.

Other features and advantages of the present invention are inherent in the cord lock and vacuum cleaner claimed and disclosed or will become apparent to those skilled in the art from the following detailed description in conjunction with the accompanying drawings.

BRIEF DESCRIPTION OF THE DRAWINGS

For a more complete understanding of the present invention, reference should be made to the accompanying drawings wherein:

FIG. 5 is a bottom perspective view of a cord lock made in accordance with the present invention;

FIG. 6 is a bottom plan view of a cord lock made in accordance with the present invention;

FIG. 7 is a side plan view of a cord lock made in accordance with the present invention;

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
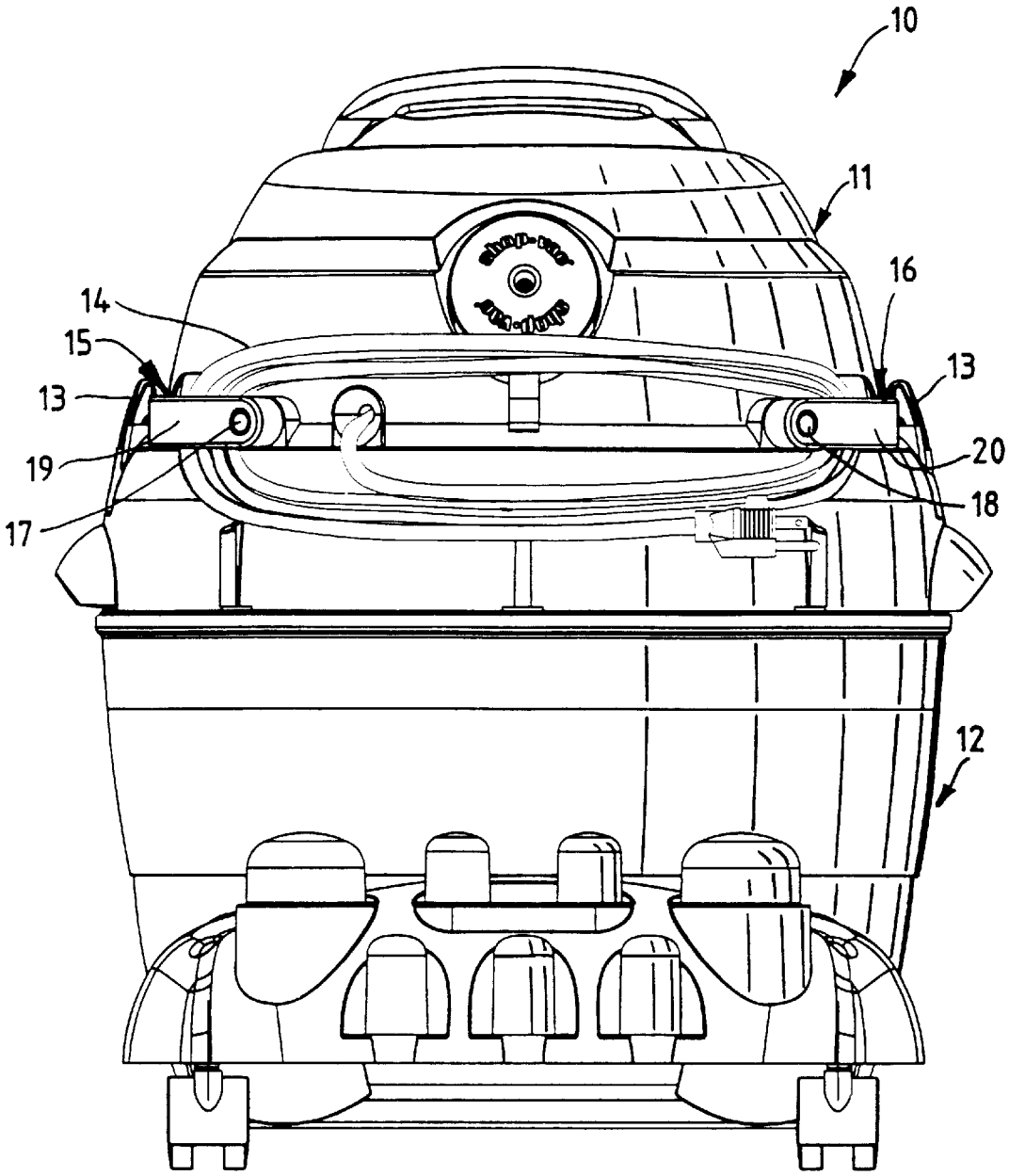
FIG. 1 is a front plan view of a vacuum cleaner and cord lock made in accordance with the present invention.
Figure 2:
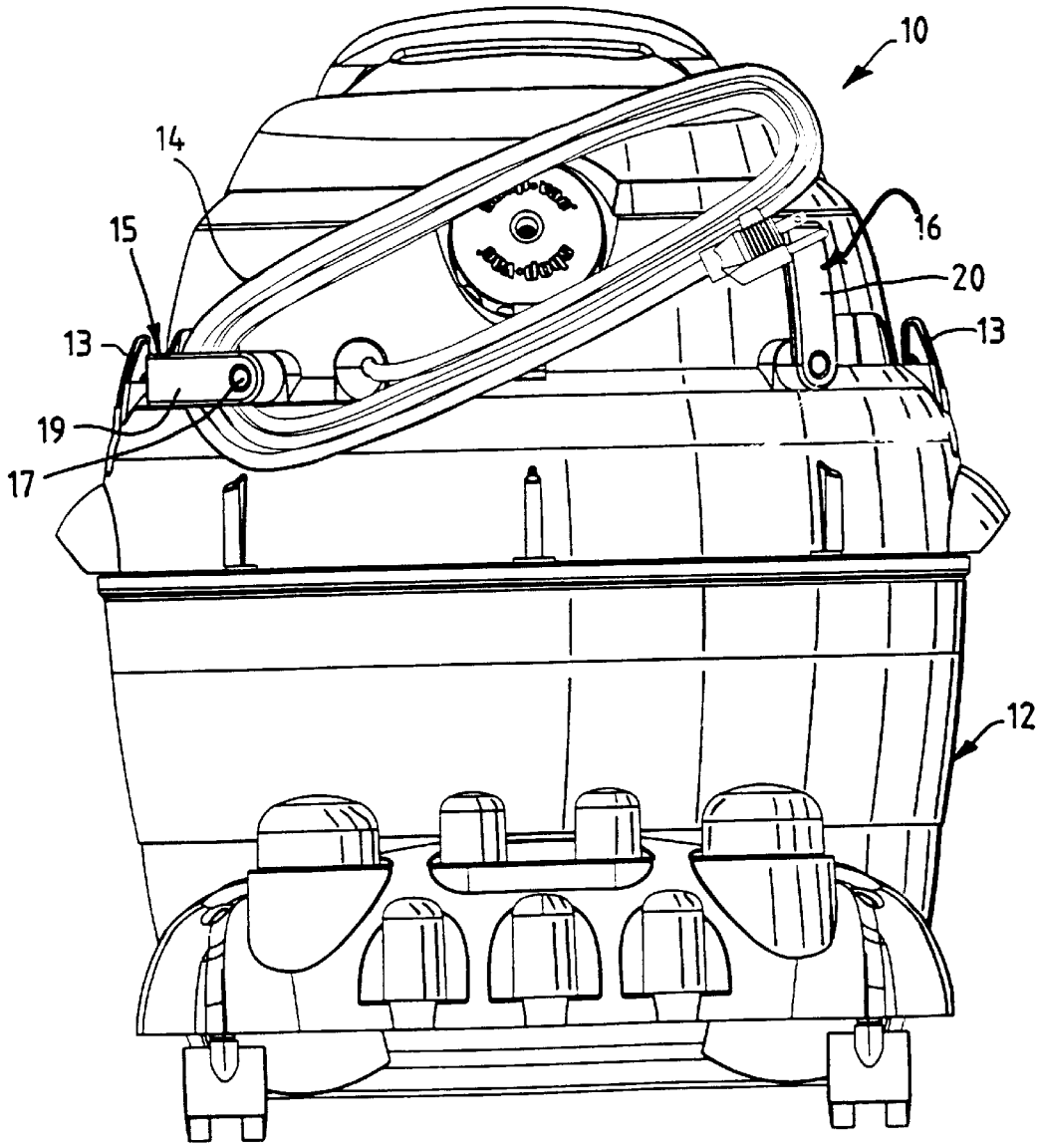
FIG. 2 is another front plan view of the vacuum cleaner and cord lock shown in FIG. 1 with the right cord lock being moved to an upright position to facilitate removal of the cord.

Referring initially to FIG. 1, a tank-type vacuum cleaner 10 is illustrated which includes an upper housing 11 connected to a lower housing or tank 12 by the clips shown at 13. The upper housing 11 typically accommodates the motor and impeller (not shown). The lower housing 12 typically serves as a tank for the collection of debris and fluid. The power cord 14 is held in position against the housings 11, 12 by two cord locks 15, 16. The cord locks 15, 16 are pivotally attached to the housing 11 by shafts 17, 18 respectively. Each cord lock 15, 16 includes a leg portion 19, 20 which serve as hooks for holding the cord 14 in the horizontal loop position as shown in FIG. 1. As shown in FIG. 2, the cord lock 16 can be pivoted from the horizontal position shown in FIG. 1 to the vertical position shown in FIG. 2 to assist the user in removing the cord 14 from the cord locks 15, 16. It will be noted that the cord lock 15 is also capable of the same upward pivoting action to a vertical position as well.

Figure 3:
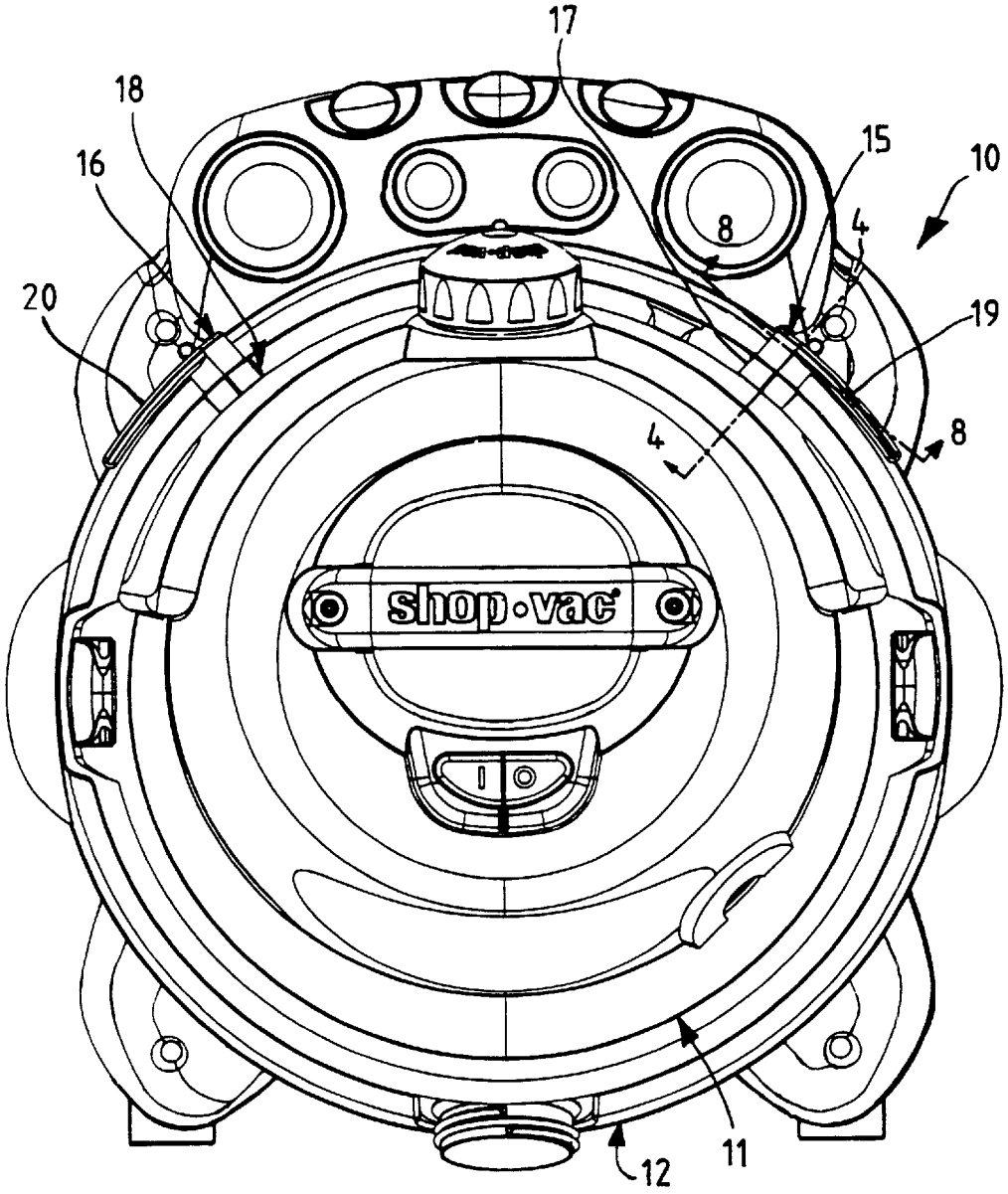
FIG. 3 is a top plan view of the vacuum cleaner and cord lock shown in FIG. 1, without the cord.
Figure 4:
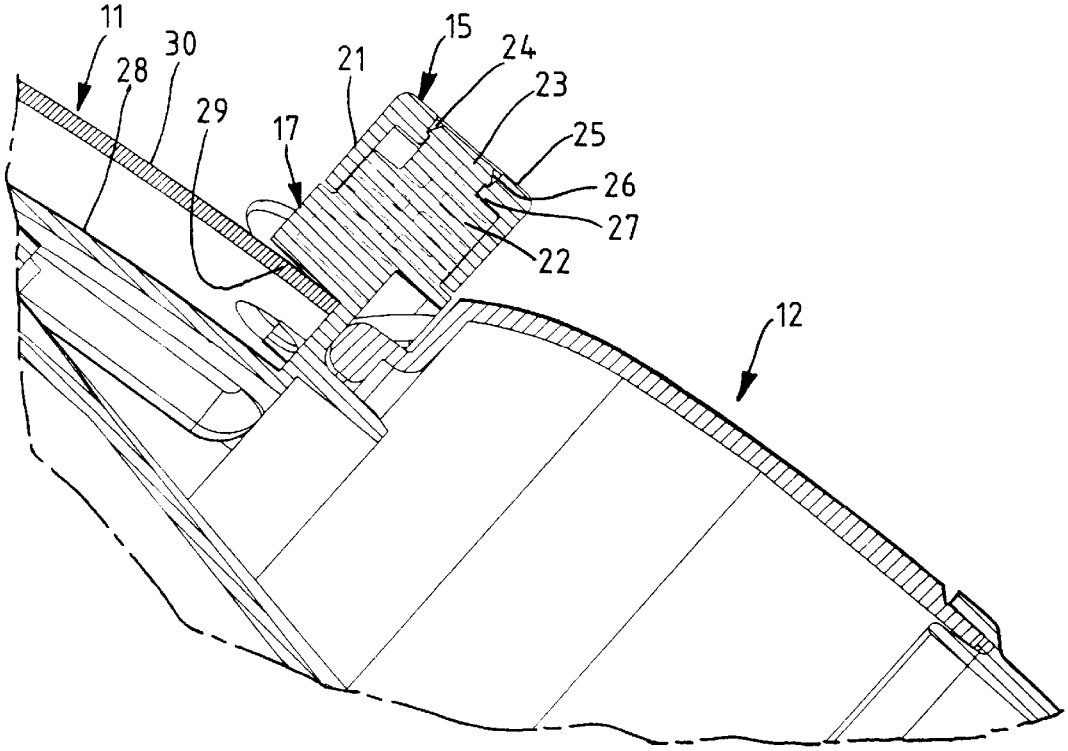
FIG. 4 is a sectional view taken substantially along line 4—4 of FIG. 3.

Turning to FIGS. 3–7, as noted above, the cord locks 15, 16 are mounted over the shafts 17, 18. Referring to the illustration of the cord lock 15 and shaft 17 of FIG. 4 and the illustration of the cord lock 15 as shown in FIGS. 5–7, the cord lock 15 includes a cylindrical base portion 21 that receives a distal end section 22 of the shaft 17. The distal end section 22 of the shaft 17 includes a male protuberance 23 that is received in the female hole 24 of the top wall 25 of the base portion 21 of the cord lock 15. As shown in FIG. 4, the protuberance 23 includes an outwardly extending ledge 26 that snap fits over the rim 27 of the hole 24. It will be noted that the shaft 17 can be integrally molded with a part of the housing structure. In the embodiment illustrated in FIG. 4, the shaft 17 is integrally molded with the lower housing or lid 28 and the proximal end of the shaft 29 abuts the outer shell 30. It will also be noted that the shafts 17, 18 can be connected to the lower housing 12 as well or may be secured to either housing 11, 12 by other fastening means that will be apparent to those skilled in the art.

Figure 8:
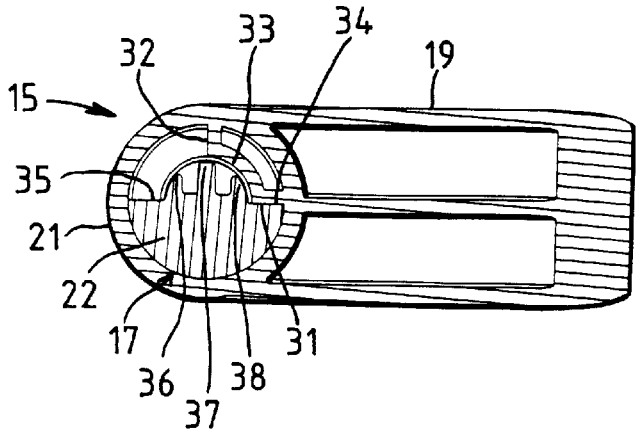
FIG. 8 is a sectional view taken substantially along line 8—8 of FIG. 3.
Figure 9:
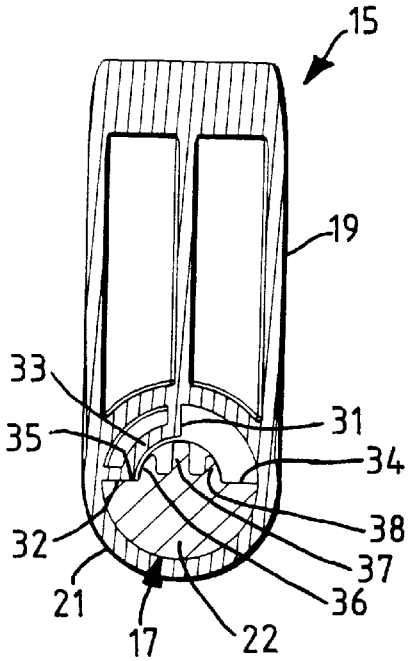
FIG. 9 is also a sectional view taken substantially along line 8—8 of FIG. 3 illustrating the cord lock rotated to the upright position.

Turning to FIG. 6, the base section 21 of the cord lock 15 has two stops, including a first stop 31 and a second stop 32. In the embodiment illustrated in FIG. 6, the first and second stops 31, 32 are connected by an arcuate wall 33. Similarly, as shown in FIG. 8, the distal end section 22 of the shaft 17 includes a first stop 34 and a second stop 35. Fingers 36, 37, 38 are disposed between the stops 34, 35 for strength purposes as well as for providing an abutting surface for the arcuate wall 33 of the cord lock 15. The first stop 31 of the cord lock 15 engages the first stop 34 of the shaft 17 when the cord lock 15 is in the horizontal position as shown in FIGS. 1, 3 and 4. Further, the second stop 32 of the cord lock 15 engages the second stop 35 of the shaft 17 when the cord lock 15 is in the vertical position as shown FIG. 9. Thus, the combination of the first stop 31, second stop 32 of the cord lock 15 and the first stop 34, second stop 35 of the shaft 17 limits the pivotal movement of the cord lock 15 to an arc of 90°, or between an outwardly directed horizontal position as shown in FIG. 8 and an upwardly directed vertical position as shown in FIG. 9. It will be noted that a 90° arc of movement for the cord locks is only one embodiment of the present invention.

However, the inventor has found that limiting the movement of the cord lock to a range of substantially less than 180° provides a number of benefits. Specifically, the user recognizes that the cord lock has only two extreme positions, an up position as shown in FIG. 9 and a horizontal position as shown in FIG. 8. Thus, the user easily recognizes that the horizontal position is used to secure the cord to the vacuum cleaner 10 and that the vertical position is used to remove the cord from the vacuum cleaner 10. It is also advantageous, but not necessary, to have two cord locks 15, 16 capable of limited pivotal movement so that the user can pivot either cord lock to remove the cord 14.

Another advantage of the present invention as exemplified in FIGS. 1–9 is that the cord lock 15 may have the same geometry as the cord lock 16. Thus, a single part may be used for either cord lock. If this technique is used, the geometry of the shaft 17 can be used for the shaft 18 with the exception that it would be rotated 90°.

Thus, an improved cord retainer system is provided which maintains the cord 14 in a horizontal position against the vacuum cleaner 10. The cord locks 15, 16 have a limited pivotal movement ranging from about 80° to about 135° from a horizontal position or near horizontal position to an upright or near upright position. The limited pivotal movement of the cord locks 15, 16 makes them easier and less confusing to use. Further, the horizontal alignment of the cord locks 15, 16 on the vacuum cleaner 10 makes it easier to wrap the cord 14 around the locks 15, 16 without tipping the vacuum cleaner 10 over.

While only certain embodiments have been set forth, alternative embodiments and various modifications will be apparent from the above description to those skilled in the art. These and other alternatives are considered equivalents and within the spirit and scope of the present invention.

What is claimed is:

1. A cord retainer for a vacuum cleaner comprising:

a right shaft and a left shaft, the right and left shafts disposed substantially horizontally, the right and left shafts each comprising a first stop and a second stop, the right shaft being pivotally connected to a right cord lock, the left shaft being connected to a left cord lock, the right and left cord locks each comprising a base for receiving one of the right and left shafts respectively and a leg portion that extends substantially perpendicularly outward from its respective base, the right cord lock comprising a first stop for engaging the first stop of the right shaft, the right cord lock also comprising a second stop for engaging the second stop of the right shaft, the right cord lock being pivotable along an arc limited by engagement of the first stops of the right shaft and right cord lock and by engagement of the second stops of the right shaft and right cord lock, the left cord lock comprising a first stop for engaging the first stop of the left shaft, the left cord lock also comprising a second stop for engaging the second stop of the left shaft, the left cord lock being pivotable along an arc limited by engagement of the first stops of the left shaft and left cord lock and by engagement of the second stops of the left shaft and left cord lock the right shaft comprising an outwardly directed male protuberance and the right cord lock comprising a top wall having a female opening, the male protuberance of the right shaft being snap fitted into the female opening of the right cord lock, and the left shaft comprising an outwardly directed male protuberance and the left cord lock comprising a top wall having a female opening, the male protuberance of the left shaft being snap fitted into the female opening of the left cord lock.

2. The cord retainer of claim 1 wherein the right and left shafts are disposed along a horizontal plane.

3. The cord retainer of claim 2 wherein the right and left shafts are fast with a housing.

4. The cord retainer of claim 1 wherein the arc through which the right cord lock can pivot ranges from about 80° to about 135°, and the arc through which the left cord lock can pivot ranges from about 80° to about 135°.

5. The cord retainer of claim 1 wherein the arcs through which the right cord lock and left cord lock can pivot are about 90°.

6. The cord retainer of claim 1 wherein the first stop of the right shaft engages the first stop of the right cord lock when the right cord lock is in a first position, the second stop of the right shaft engages the second stop of the right cord lock when the right cord lock is in a second position, the first stop of the left shaft engages the first stop of the left cord lock when the left cord lock is in a first position, the second stop of the left shaft engages the second stop of the left cord lock when the left cord lock is in a second position, the leg portions of the right and left cord locks being substantially coplanar and oppositely directed when the right and left cord locks are in their respective first positions, the leg portions of the right and left cord locks being substantially parallel and upwardly directed when the right and left cord locks are in their respective second positions.

7. The cord retainer of claim 1 wherein the first and second stops of the right cord lock are disposed along an arc of about 90° and the first and second stops of the right shaft are disposed along an arc of about 180°, and wherein the first and second stops of the left cord lock are disposed along an arc of about 90° and the first and second stops of the left shaft are disposed along an arc of about 180°.

8. The cord retainer of claim 7 wherein the first and second stops of the right cord lock are connected by an arcuate wall, and wherein the first and second stops of the left cord lock are connected by an arcuate wall.

9. The cord retainer of claim 1 wherein the right cord lock is interchangeable with the left cord lock.

10. A vacuum cleaner comprising:

a housing, the housing being connected to a right shaft and a left shaft, the right and left shafts extending outward from the housing, the right and left shafts each comprising a first stop and a second stop, the right shaft being pivotally connected to a right cord lock, the left shaft being connected to a left cord lock, the right and left cord locks each comprising a hollow base for receiving one of the right and left shafts respectively and a leg portion that extends substantially perpendicularly outward from its respective base, the hollow base of the right cord lock comprising a first stop for engaging the first stop of the right shaft, the hollow base of the right cord lock comprising a second stop for engaging the second stop of the right shaft, the hollow base of the left cord lock comprising a first stop for engaging the first stop of the left shaft, the hollow base of the left cord lock comprising a second stop for engaging the second stop of the left shaft, the first stop of the right shaft engaging the first stop of the right cord lock when the right cord lock is in a first position, the second stop of the right shaft engaging the second stop of the right cord lock when the right cord lock is in a second position, the first stop of the left shaft engaging the first stop of the left cord lock when the left cord lock is in a first position, the second stop of the left shaft engaging the second stop of the left cord lock when the left cord lock is in a second position, the legs of the right and left cord locks being substantially coplanar and substantially oppositely directed when the right and left cord locks are in their respective first positions, the legs of the right and left cord locks being substantially parallel and upwardly directed when the right and left cord locks are in their respective second positions the right shaft comprising an outwardly directed male protuberance and the hollow base of the right cord lock comprising a top wall having a female opening, the male protuberance of the right shaft being snap fitted into the female opening of the right cord lock, and the left shaft comprising an outwardly directed male protuberance and the hollow base of the left cord lock comprising a top wall having a female opening, the male protuberance of the left shaft being snap fitted into the female opening of the left cord lock.

11. The vacuum cleaner of claim 10 wherein the right and left shafts are connected to the housing along a horizontal plane when the vacuum cleaner is in an upright position.

12. The vacuum cleaner of claim 10 wherein engagement between the first stops of the right shaft and the right cord lock and engagement between the second stops of the right shaft and the right cord lock limits pivotal movement of the right cord lock to an arc ranging from about 80° to about 135°, and wherein engagement between the first stops of the left shaft and the left cord lock and engagement between the second stops of the left shaft and the left cord lock limits pivotal movement of the left cord lock to an arc ranging from about 80° to about 135°.

13. The vacuum cleaner of claim 10 wherein engagement between the first stops of the right shaft and the right cord lock and engagement between the second stops of the right shaft and the right cord lock limits pivotal movement of the right cord lock to an arc of about 90°, and wherein engagement between the first stops of the left shaft and the left cord lock and engagement between the second stops of the left shaft and the left cord lock limits pivotal movement of the left cord lock to an arc of about 90°.

14. The vacuum cleaner of claim 10 wherein the first and second stops of the right cord lock are disposed along an arc of about 90° and the first and second stops of the right shaft are disposed along an arc of about 180°, and wherein the first and second stops of the left cord lock are disposed along an arc of about 90° and the first and second stops of the left shaft are disposed along an arc of about 180°.

15. The vacuum cleaner of claim 14 wherein the first and second stops of the right cord lock are connected by an arcuate wall, and wherein the first and second stops of the left cord lock are connected by an arcuate wall.

16. The vacuum cleaner of claim 10 wherein the right cord lock is interchangeable with the left cord lock.

17. The vacuum cleaner of claim 10 wherein the right and left shafts are fast with the housing.

18. A cord retainer for a vacuum cleaner comprising:

a right shaft and a left shaft, the right and left shafts disposed substantially horizontally, the right and left shafts each comprising a first stop and a second stop, the right shaft being pivotally connected to a right cord lock, the left shaft being connected to a left cord lock, the right and left cord locks each comprising a hollow base for receiving one of the right and left shafts respectively and a leg portion that extends substantially perpendicularly outward from its respective base, the right shaft comprising an outwardly directed male protuberance and the hollow base of the right cord lock comprising a top wall having a female opening, the male protuberance of the right shaft being snap fitted into the female opening of the right cord lock, and the left shaft comprising an outwardly directed male protuberance and the hollow base of the left cord lock comprising a top wall having a female opening, the male protuberance of the left shaft being snap fitted into the female opening of the left cord lock, the right and left cord locks being interchangeable.

19. The cord retainer of claim 18 wherein the right cord lock further comprises a first stop for engaging the first stop of the right shaft, the right cord lock also comprising a second stop for engaging the second stop of the right shaft, the right cord lock being pivotal along an arc of less than 120° that is defined by engagement of the first stops of the right shaft and right cord lock and by engagement of the second stops of the right shaft and cord lock, the left cord lock further comprises a first stop for engaging the first stop of the left shaft, the left cord lock also comprising a second stop for engaging the second stop of the left shaft, the left cord lock being pivotal along an arc of less than 120° that is defined by engagement of the first stops of the left shaft and left cord lock and by engagement of the second stops of the left shaft and cord lock.

20. A tank-type vacuum cleaner having a tank and an upper housing closing the tank and from which a power cord extends, the vacuum cleaner including a cord retainer, the cord retainer comprising:

a right cord lock and a left cord lock mounted on the upper housing from which the cord extends and wherein the right and left cord locks move from a first position in which the cord is retained to a second position in which the cord is released, the right and left locks being pivotally mounted on right and left shifts respectively, the right shaft comprising an outwardly directed male protuberance and the hollow base of the right cord lock comprising a top wall having a female opening, the male protuberance of the right shaft being snap fitted into the female opening of the right cord lock, and the left shaft comprising an outwardly directed male protuberance and the hollow base of the left cord lock comprising a top wall having a female opening, the male protuberance of the left shaft being snap fitted into the female opening of the left cord lock.

* * * * *